US009302374B1

(12) United States Patent
Cusenza

(10) Patent No.: US 9,302,374 B1
(45) Date of Patent: Apr. 5, 2016

(54) SOFT JAW—PROTECTIVE TOOL COVER

(71) Applicant: David Cusenza, Port Orchard, WA (US)

(72) Inventor: David Cusenza, Port Orchard, WA (US)

( * ) Notice: Subject to any disclaimer, the term of this patent is extended or adjusted under 35 U.S.C. 154(b) by 0 days.

(21) Appl. No.: 14/611,207

(22) Filed: Jan. 31, 2015

Related U.S. Application Data

(60) Provisional application No. 61/983,206, filed on Apr. 23, 2014.

(51) Int. Cl.
*B25B 7/02* (2006.01)
*B25B 13/58* (2006.01)

(52) U.S. Cl.
CPC .. *B25B 13/58* (2013.01); *B25B 7/02* (2013.01)

(58) Field of Classification Search
CPC ..... B25B 13/58; B25B 7/02
USPC ..... 81/427, 421, 185.1
See application file for complete search history.

(56) References Cited

U.S. PATENT DOCUMENTS 2,766,649 A * 10/1956 Labry, Jr. ..... B25B 1/2452 269/274
4,569,511 A * 2/1986 Bell, Jr. ..... B25B 1/2452 269/276
4,905,550 A * 3/1990 Albrecht ..... B25B 7/04 81/185.1
D340,851 S * 11/1993 Sorensen ..... D8/499
5,988,616 A * 11/1999 Fuller ..... B25B 5/163 269/147
6,339,980 B1 * 1/2002 Woolf ..... B25B 23/00 81/185
8,459,152 B2 * 6/2013 Keong ..... B25B 13/08 76/114
8,707,833 B1 * 4/2014 Gedeon ..... B25B 7/10 81/414

* cited by examiner

*Primary Examiner* — Hadi Shakeri
*Assistant Examiner* — Danny Hong

(57) ABSTRACT

Embodiments of the disclosure describe a protective tool cover and a method of making the protective tool cover. The embodiments comprises a protective tool cover having a proximate and distal end; an internal cavity continuing from the proximate to the distal end, the internal cavity being adapted to receive a jaw portion of a tool in order to enclose the jaw portion of the tool with the cover; and a portion of the cover connecting the proximate and distal end, positioned to interact with the jaw portion of the jaw of the tool.

9 Claims, 4 Drawing Sheets

SOFT JAW—PROTECTIVE TOOL COVER

This application claims the benefit of U.S. Provisional Application No. 61/983,206, filed Apr. 24, 2014. The content of this application is hereby incorporated by reference in its entirety.

FIELD OF INVENTION

The presently disclosed subject matter includes an apparatus and methods of creating a protective tool cover for hand tools and power tools.

BACKGROUND

Hand tools are indispensable for a variety of needs. There are a wide range of possible uses for hand tools and many of these tools have jaws that require direct contact of the tool's jaws with the material being worked on. Often, these hand tools have or need to create a fulcrum to generate enough force and torque to accomplish tasks. These tools are generally constructed of metal, such as steel, or another hard material in order to withstand the force and torque generated by use. The tool's strength is principally due to its hardness, but this hardness can also easily damage or mark the item where the tool or jaws are being used to grip the targeted material.

If hand tools with jaws are used on soft metals like aluminum or brass, or even softer materials like wood or plastic, the jaws of the tools will most likely permanently damage those materials. In addition, decorative plating, functional plating, or vacuum metalizing on surfaces may also be permanently damaged by the use of hand tools. The pressure exerted by the user through the jaw of the tool and onto the soft metal or finished surfaces can cause damage through normal use of the tool.

DETAILED DESCRIPTION

The embodiments of the disclosure provide for a protective tool cover. In the embodiments, the protective tool cover is placed over the jaws of a tool, in order to avoid damage to soft metals and other materials, along with finished surfaces in close proximity. Embodiments of the disclosure also provide a method of making the protective tool cover. The disclosure will be understood more fully from the detailed description given below and from the accompanying drawings of various embodiments of the disclosure. The drawings, however, should not be taken to limit the disclosure to the specific embodiments, but are for explanation and understanding only.

The protective tool cover implementations of the disclosure may be used to cover the entire jaw of a tool and may be useful in preventing damage when a tool is being used on a variety of materials. FIGS. 1-4 show basic example embodiments of the protective tool cover.

Figure 1:
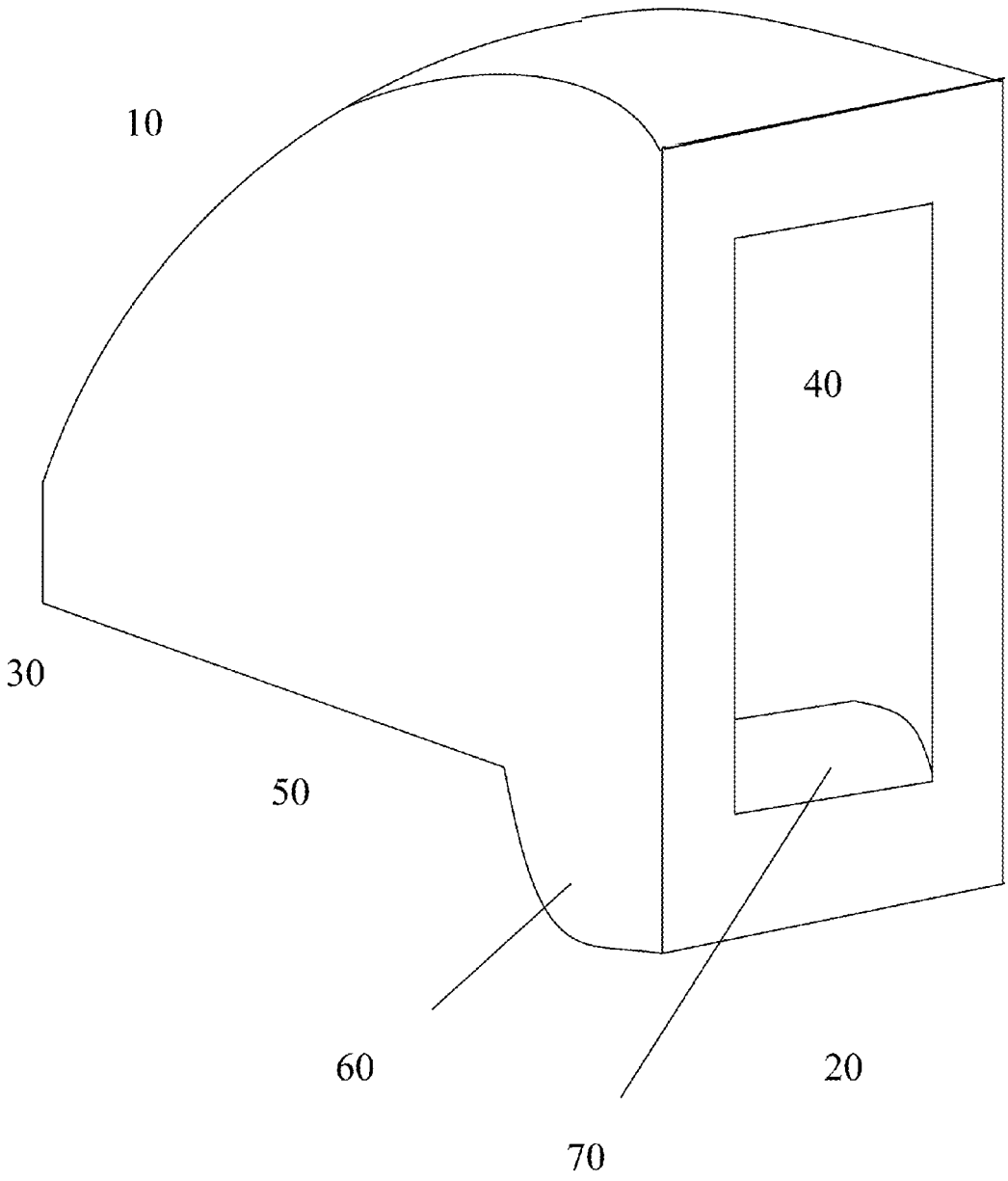
FIG. 1 illustrates one embodiment of the proximate end of a protective tool cover showing in a three-quarters view.

As shown in FIG. 1, in the preferred embodiment of the protective tool cover consists of a cover 10 which may have a proximate 20 and distal end 30, an internal cavity 40 continuing from the proximate 20 to the distal end 30, the internal cavity 40 being adapted to receive a jaw portion of a tool in order to enclose the jaw portion of the tool with the cover. In other embodiments, there may also include a portion of the cover connecting the proximate and distal ends, positioned to interact with the jaw portion of the tool 50.

In some embodiments, the cover further includes an extension at the proximate end of the portion connecting the proximate and distal ends which is adapted to further interact with the back of tool jaw 60. In other embodiments, the proximate end further comprises a raised jaw-locking knob 70. In all embodiments, the protective tool cover may be removed from the jaw portion of the tool.

Figure 2:
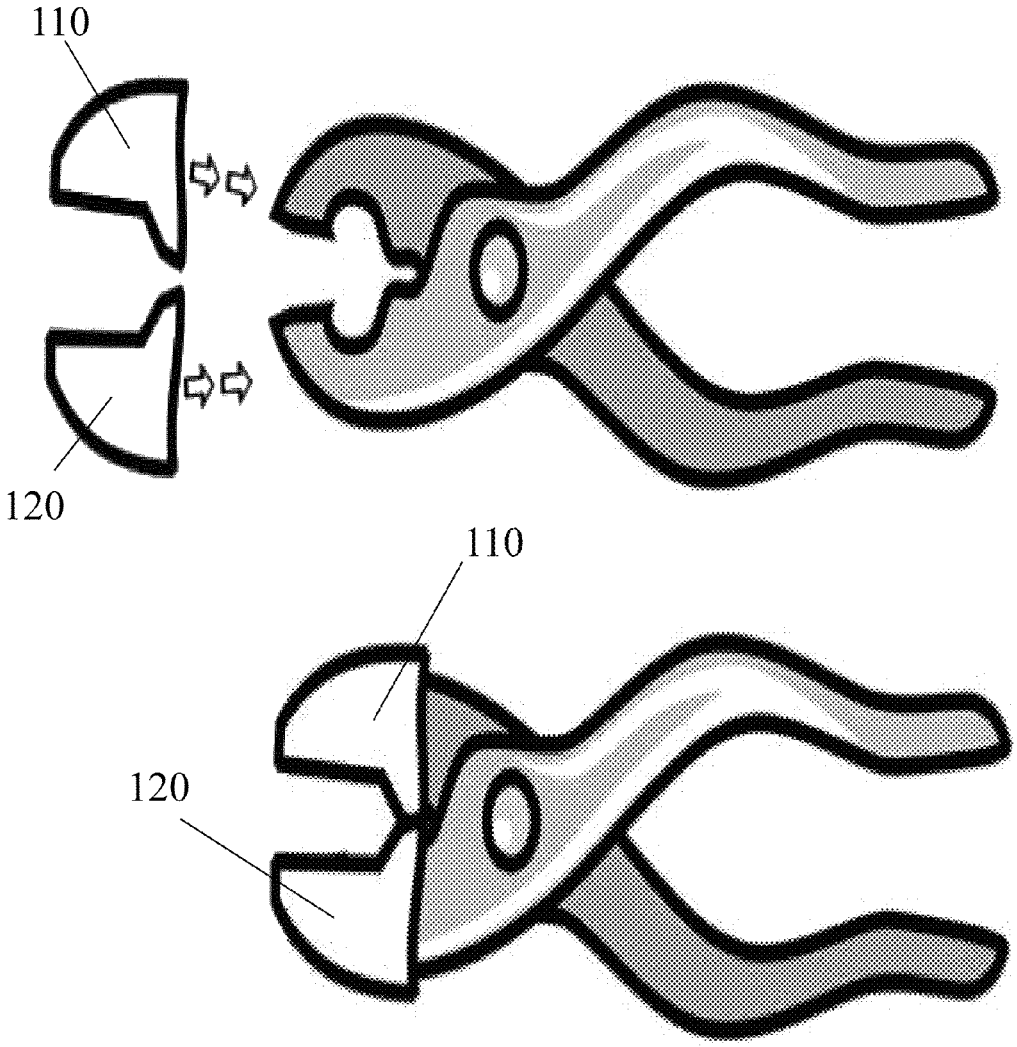
FIG. 2 illustrates an embodiment where a protective tool cover is utilized on both the upper and lower jaw of the tool.
Figure 3:
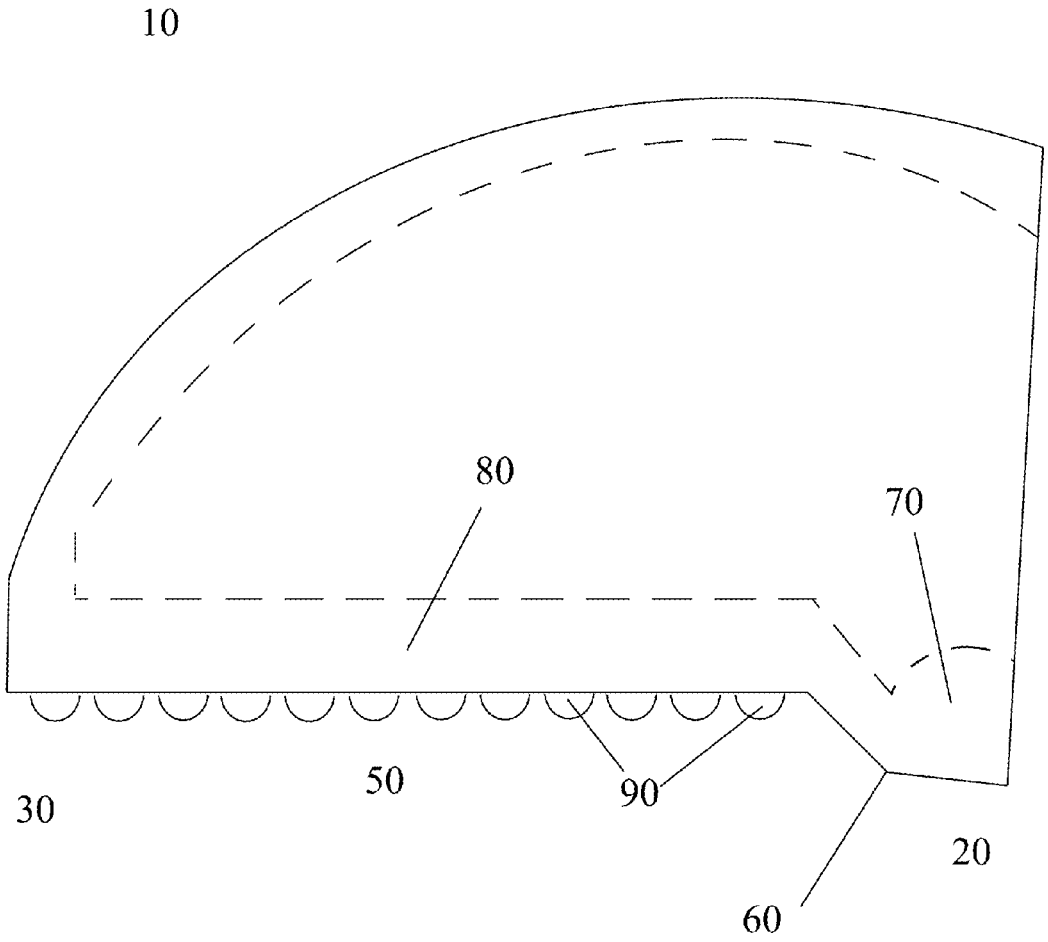
FIG. 3 illustrates an embodiment the protective tool cover is in a sectional, profile view.

As shown in FIG. 2, in this embodiment the protective tool cover may utilize a co ver for both the upper jaw of the tool 110 as well as a cover for the lower jaw of the tool 120. FIG. 3 shows the protective tool cover in a sectional, profile view of some embodiments. In other embodiments the portion connecting the proximate and distal ends is thicker than the rest of the cover 80. In still other embodiments, the connecting portion between the proximate and distal end has grips 90.

Figure 4:
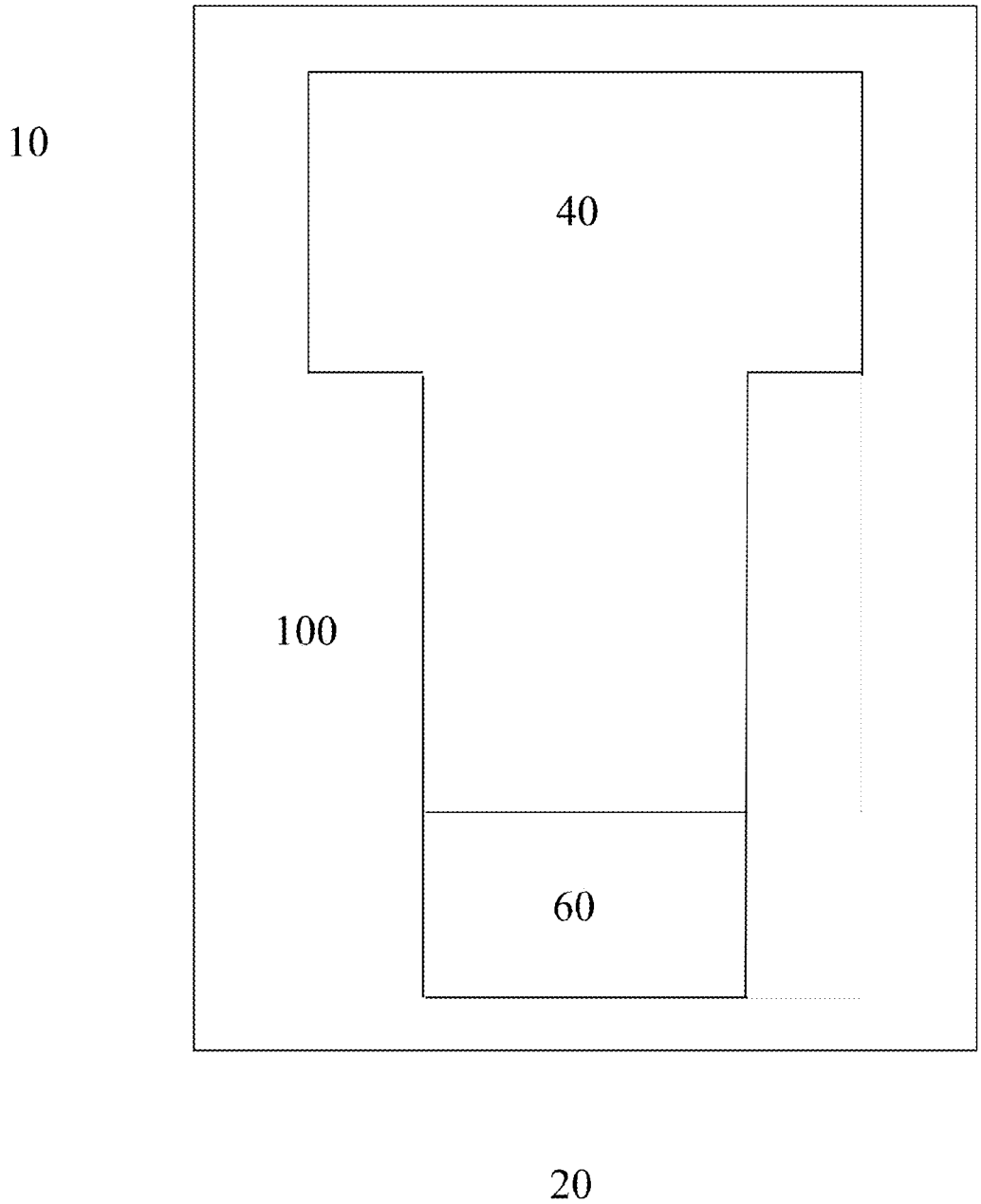
FIG. 4 illustrates an embodiment of the proximate end of the protective tool cover.

FIG. 4 illustrates an embodiment of the proximate end of the cover. In some embodiments the sides of the cover 100 extend into the internal cavity 40. In certain embodiments, the sides of the cover 100 that extend into the internal cavity 40 may help to secure the protective tool cover to the jaw portion of the tool.

In the preferred embodiment, the protective tool cover is made from nitrile, ethylene propylene diene monomer (EPDM), neoprene, styrene-butadiene rubber (SBR), or polyisoprene, along with other elastomers such as, but not limited to, natural rubber, synthetic rubber, silicone, butyl (IIR), urethane, other thermoplastic elastomers (TPE) or mixtures thereof.

In each embodiment, the protective tool cover may be made through molding techniques known to those of skill in the art such as pressure, transfer or injection molding. The optimum hardness of the protective tool cover ranges from about 30 to 90 as measured on durometer scales.

The protective tool cover may be, but is not limited to, being used with power tools in addition to hand tools with jaws. These tools are typically clamping devices. The tool may be pliers, slip joint pliers, locking pliers, tongue and groove pliers, and needle-nose pliers along with other tools with jaws including, but not limited to, pipe wrenches, monkey wrenches, alligator wrenches, plumber wrench, and other adjustable jawed tools.

There are various methods of making a protective tool cover. Methods include, but are not limited, to molding or forming. Molding techniques may include, but are not limited to pressure, transfer, injection molding as well as other molding and forming techniques known to those of skill in the art.

In all of these manufacturing methods, the polymers, copolymers, block polymers rubbers, rubber-like materials or combinations thereof are also molded or formed to include a cover 10 having a proximate 20 and distal end 30 where the internal cavity 40 continues from the proximate 20 to the distal end 30; and a portion of the cover connects the proximate and distal end and is positioned to interact with the jaw portion of the jaw of the tool 50.

The manufacturing methods may include molding or forming elastomers, polymers, copolymers, block polymers rubbers, rubber-like materials or combinations thereof to include an extension at the proximate end of the portion connecting the proximate and distal ends which is adapted to further interact with the back of the tool jaw 60. In other embodiments, the method may also include molding elastomers, polymers, copolymers, block polymers rubbers, rubber-like materials or combinations thereof to include a raised jaw-locking knob 70. In still other embodiments, the method may further include a thicker portion connecting the proximate and distal end is than the rest of the cover 80 and grips on the connection portion between the proximate and distal 90. In all embodiments, the method provides a cover which is removable from the jaw portion of a tool.

In the foregoing description, numerous details are set forth. It will be apparent, however, that the disclosure may be practiced without these specific details. In some instances, well-known structures and devices are shown in block diagram form, rather than in detail, in order to avoid obscuring the disclosure.

Whereas many alterations and modifications of the disclosure will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims, which in themselves recite only those features regarded as the disclosure.

What is claimed is:

1. A protective tool cover comprising:

a cover having a proximate and distal end;

an internal cavity continuing from the proximate to the distal end, the internal cavity being adapted to receive a jaw portion of a tool in order to enclose the jaw portion of a tool with the cover;

a portion of the cover connecting the proximate and distal end, positioned to interact with the jaw portion of a tool;

a proximate end extension of the portion connecting the proximate and distal end adapted to further interact with the back of the jaw portion; and a raised jaw-locking knob located near the proximate end;

wherein the cover material is selected from the group consisting of nitrile, ethylene propylene diene monomer (EPDM), neoprene, styrene-butadiene rubber (SBR), polyisoprene, elastomers, natural rubber, synthetic rubber, silicone, butyl (IIR), urethane, thermoplastic elastomers (TPE) or mixtures thereof with a hardness ranging between 30 to about 90 as measured on durometer scales.

2. The protective tool cover of claim 1, wherein the cover further comprises a cover for an upper jaw portion of a tool and a cover for a lower jaw portion of a tool.

3. The protective tool cover of claim 1, wherein the cover is removable.

4. The protective tool cover of claim 1, wherein the portion connecting the proximate and distal end is thicker configured to house the jaw portion of a tool with the cover.

5. The protective tool cover of claim 1, wherein the portion connecting the proximate and distal end further comprises grips.

6. The protective tool cover of claim 1, wherein the cover is molded or formed.

7. The protective tool cover of claim 6, wherein the cover is molded through pressure, transfer or injection molding.

8. The protective tool cover of claim 1, wherein the tool is a hand tool or power tool.

9. The protective tool cover of claim 8, wherein the tool is selected from the group consisting of clamps, pliers, slip-joint pliers, locking pliers, tongue and groove pliers, needle-nose pliers, pipe wrenches, monkey wrenches, alligator wrenches, plumber wrench or other adjustable jawed tools.

* * * * *